US006866229B1

(12) United States Patent
Tabor et al.

(10) Patent No.: US 6,866,229 B1
(45) Date of Patent: Mar. 15, 2005

(54) KITE WITH DURABLE LIGHT DISPLAY FEATURE

(76) Inventors: Don Tabor, 30765 Pacific Coast Hwy., Malibu, CA (US) 90265; Francis Alonso, 30765 Pacific Coast Hwy., Malibu, CA (US) 90265

( * ) Notice: Subject to any disclaimer, the term of this patent is extended or adjusted under 35 U.S.C. 154(b) by 0 days.

(21) Appl. No.: 10/877,712

(22) Filed: Jun. 25, 2004

Related U.S. Application Data

(60) Provisional application No. 60/558,226, filed on Mar. 30, 2004.

(51) Int. Cl.[7] ..... A63H 27/08

(52) U.S. Cl. ..... 244/153 R; 362/470; 362/253; 446/34

(58) Field of Search ..... 244/153 R, 155 R; 362/470, 459, 806, 253; 446/34

(56) References Cited

U.S. PATENT DOCUMENTS

| | | | | |
|---|---|---|---|---|
| 2,434,077 | A | 1/1948 | Lang | |
| 2,442,417 | A | 6/1948 | Lang | |
| 2,750,136 | A | 6/1956 | Stracke, Jr. | |
| 4,942,506 | A | 7/1990 | Flory | |
| 5,000,402 | A | 3/1991 | Blackburn | |
| 5,018,056 | A | 5/1991 | Hou | |
| 5,098,039 | A | 3/1992 | Linden, Jr. | |
| 5,288,038 | A | 2/1994 | Duong | |
| 5,528,476 | A | 6/1996 | Fenton | |
| D392,345 | S | 3/1998 | Burghardt | |
| 6,048,246 | A | 4/2000 | Forti et al. | |
| 6,168,115 | B1 | 1/2001 | Abdelkhaleq | |
| 6,283,413 | B1 | 9/2001 | Bukur | |
| 6,283,414 | B1 | 9/2001 | Quinones et al. | |
| 6,402,165 | B1 | 6/2002 | Redmond | |
| 6,527,607 | B1 | 3/2003 | Huang | |
| 6,575,409 | B1 * | 6/2003 | West | 244/153 R |
| 2003/0042366 | A1 | 3/2003 | Britt et al. | |

* cited by examiner

*Primary Examiner*—J. Woodrow Eldred
(74) *Attorney, Agent, or Firm*—Louis J. Bachand

(57) ABSTRACT

An illuminated kite comprises a frame and a sail, a plurality of distributed light elements, an electrical power supply carried by the kite for illuminating the light elements, elongated electrical conductors electrically communicating the power supply and the light elements, elongated sleeves for receiving the electrical conductors, the sleeves having only a tangential attachment locus for attachment to the sail and thus free movement relative to said sail and frame with said electrical conductors therewithin about the tangential attachment locus when said kite flexes to protect the conductors within the sleeves from damage from kite sail and frame flexing.

21 Claims, 2 Drawing Sheets

KITE WITH DURABLE LIGHT DISPLAY FEATURE

RELATED APPLICATION

This application claims the benefit of United States Provisional Application Ser. No. 60/558,226, filed Mar. 30, 2004.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to kites and, more particularly, to illuminated kites having protection features against breakage of electrical conductors through the isolation of the conductors from the inevitable flexing of the kite sail and frame for increased durability.

2. Description of the Related Art

Illuminated kites are known having various lighting expedients on the kite for visual enhancement at night. There is an unmet need for protecting the delicate electrical conductors in illuminate kites effectively and inexpensively.

BRIEF SUMMARY OF THE INVENTION

It is an object of the present invention to provide an illuminated kite in which the conductors are protected from damage from flexing of the kite frame or sail in flight or when packed away. It is a further object to provide an effective and inexpensively adopted conductor protection system in a kite. It is a further object to provide a kite having conductor receiving sleeves peripherally disposed on the kite, suitably adjacent the frame pockets, and co-fastened there in a single, low-cost sewing operation. A further object is to contain the conductors in a sleeve only tangentially connected to the kite sail so that the sleeve and the conductors therewithin are able to pivot about the tangential locus of fastening of the sleeve to the sail and avoid being caught in a flexing movement of the sail or frame.

These and other objects of the invention to become apparent hereinafter are realized in a kite comprising a frame and a sail, the sail having a laterally and longitudinally extended face, a plurality of light elements distributed on the face, an electrical power supply carried by the kite for illuminating the light elements, elongated electrical conductors electrically communicating the power supply and the light elements, the kite sail defining elongated sleeves for receiving the electrical conductors, the sleeves having only a tangential attachment locus for attachment to the sail and free movement relative to the sail and frame with the electrical conductors therewithin about the tangential attachment locus when the kite flexes, whereby the electrical conductors are protected within the sleeves from damage from kite sail and frame flexing.

In this and like embodiments, typically, the light elements comprise light emitting diodes, the power supply comprises a battery, the kite includes a receptacle pocket for carrying the battery, the electrical conductors are wires comprising copper, the kite has a peripheral edge margin, the light elements being distributed within the peripheral edge margin, the light elements are supported on the kite peripheral edge margin in light element visible relation, the kite sail comprises sail fabric, the light elements protrude through the sail fabric and are supported there by cooperating annular members on opposite sides of the sail fabric, the elongated sleeves extend along the peripheral edge margins, the kite frame comprises frame members, the kite sail comprises sail fabric, the sail fabric has frame member receiving pockets at its periphery, the sail fabric has a peripheral edge margin inward of the pockets, the sleeves being attached tangentially to the peripheral edge margin, the electrical conductors lying within the sleeves in kite flexing protected relation, the light elements being connected to the electrical conductors and protruding from the sleeves in light displaying relation.

In a further embodiment, the invention provides a kite comprising a frame of frame members and a sail comprising sail fabric supported by the frame members, the sail fabric having a laterally and longitudinally extended face, a peripheral edge and a peripheral edge margin inward of the peripheral edge; a plurality of light elements distributed on the face, an electrical power supply carried by the kite for illuminating the light elements, elongated electrical conductors electrically communicating the power supply and the light elements, the kite sail fabric peripheral edge defining frame member receiving pockets, the kite sail fabric further defining elongated sleeves for receiving the electrical conductors, the sleeves having only a tangential attachment locus for attachment to the sail fabric peripheral edge margin and free movement relative to the sail and frame with the electrical conductors therewithin about the tangential attachment locus when the kite flexes, whereby the electrical conductors are protected within the sleeves from damage from kite sail and frame flexing.

In this and like embodiments, typically, the frame receiving pockets comprise a flap of the sail fabric peripheral edge folded on itself and fastened to the sail fabric outboard of the edge of the flap to leave a free flap continued extent, the electrical conductor receiving sleeves being defined by the free flap continued extent also folded onto itself and fastened to the sail fabric, and the flap and the sleeve are commonly fastened to the sail fabric along a single fastening locus with the pockets and sleeves being thereby defined on opposite sides of the locus.

In its method aspects the invention provides a method of protecting electrical connectors in an illuminated kite having a frame, a sail, and a plurality of light elements, including folding an edge of the sail on itself to form an electrical conductor receiving sleeve, and attaching the sleeve to the sail only on a tangential locus to allow for free movement of the sleeve and the conductors therewith about the tangential locus relative to the sail and frame upon flexing of the kite.

BRIEF DESCRIPTION OF THE SEVERAL VIEWS OF THE DRAWINGS

The invention will be further described in conjunction with the attached drawings in which.

DETAILED DESCRIPTION OF THE INVENTION

Figure 1:
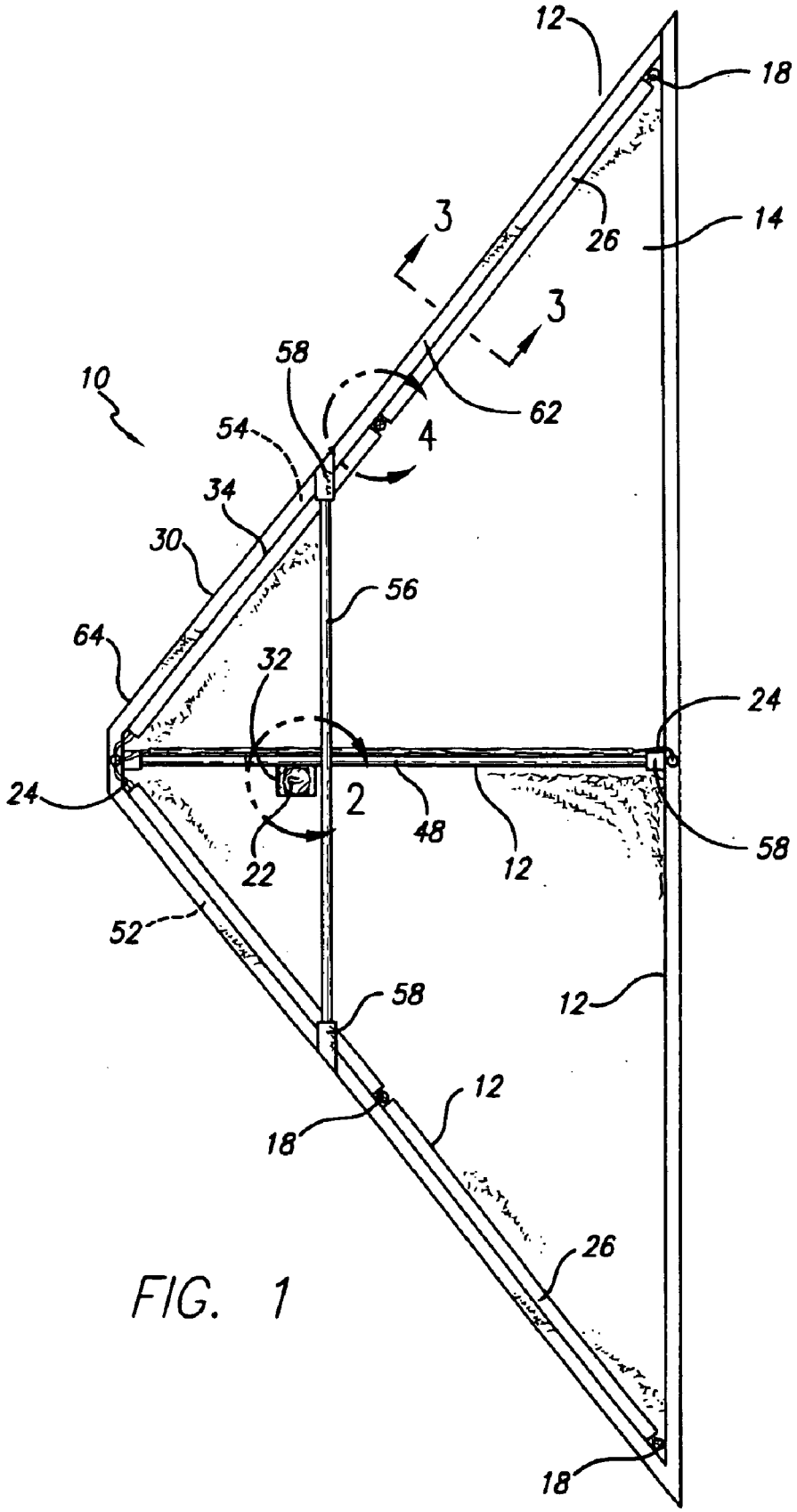
FIG. 1 is a rear face plan view of an illuminated kite according to the invention.
Figure 2:
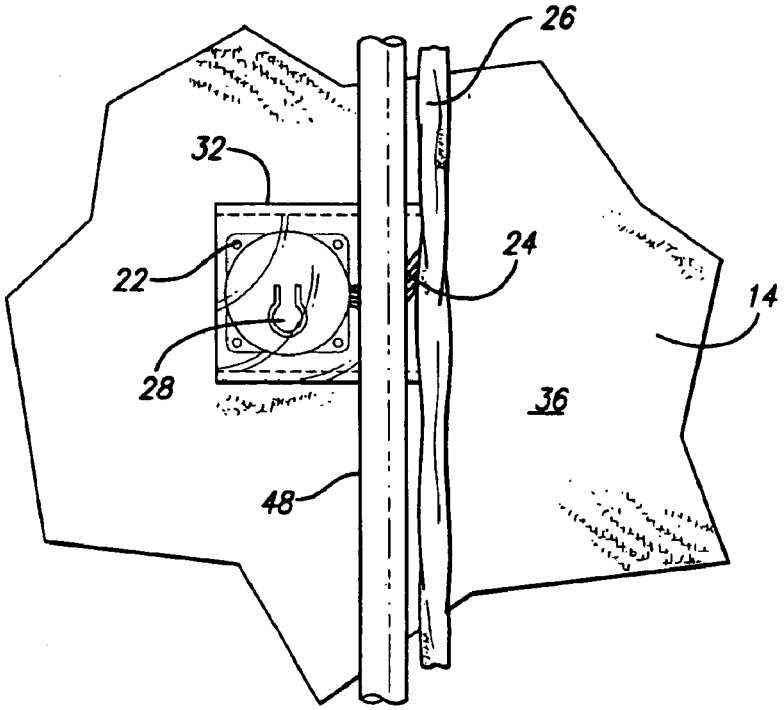
FIG. 2 is a fragmentary detail view taken on line 2 in FIG. 1.
Figure 3:
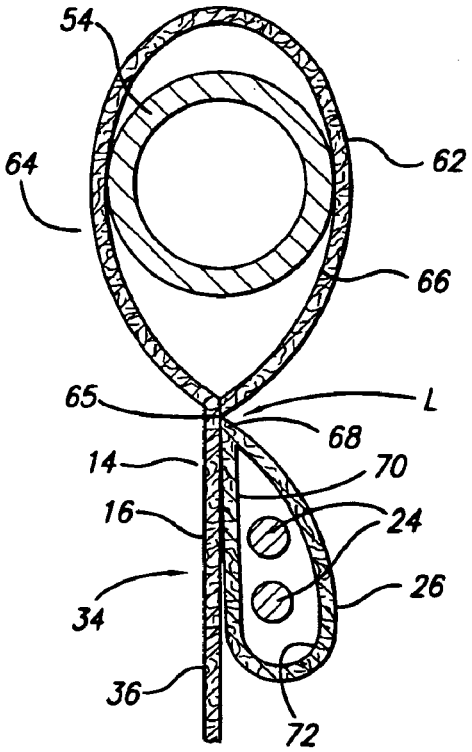
FIG. 3 is a view, enlarged, taken on line 3—3 in FIG. 1.
Figure 4:
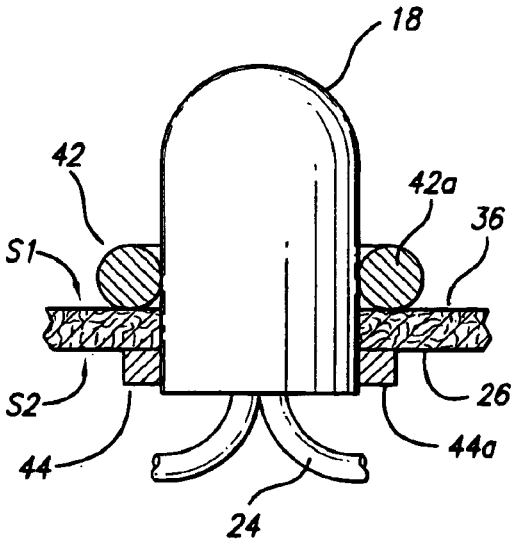
FIG. 4 is a fragmentary detail view taken on line 4 in FIG. 1.

With reference now to the drawings in detail, the invention will be further described in conjunction with FIGS. 1–4 of the drawings. Kite 10 comprises a frame 12 and a sail 14. Sail 14 has a laterally and longitudinally extended face 16, a plurality of light elements 18 distributed on the face, an electrical power supply 22 carried by the kite for illuminating the light elements, and pairs of elongated electrical conductors 24 electrically communicating the power supply and the light elements.

The kite sail 14 defines elongated sleeves 26 for receiving the electrical conductors 24. Sleeves 24 have only a tangential attachment locus L for attachment to the sail 14 so that free sleeve movement is provided relative to the sail and frame 12 with the electrical conductors 24 therewithin about the tangential attachment locus L when the kite flexes. Thus, the electrical conductors 24 are protected within the sleeves 26 from damage from kite sail and frame flexing.

Light elements 18 typically comprise light emitting diodes (LED's), but lamps and other illumination-producing devices can also be used. Power supply 22 suitably comprises a small battery 28, such as a watch battery. Kite 10 includes a receptacle pocket 32 for carrying the battery. Electrical conductors 24 are generally wire pairs comprising copper but any good conductor can be used.

Kite 10 has a peripheral edge margin 34; the light elements 18 are distributed within the peripheral edge margin and supported there in light element visible relation so that the light elements can seen from below the kite when the kite is flying.

The kite sail 14 comprises sail fabric 36 that is locally formed into sleeves 26 through which the light elements 18 protrude. Light elements 18 are supported by cooperating annular members 42, 44 including a resilient ring 42*a* and grommet 44*a* located on opposite sides S1, S2 of the sail fabric 36 forming the sleeve 26.

The elongated sleeves 26 extend along the kite peripheral edge margins 34.

Kite frame 46 comprises frame members including center strut 48, left and right side struts 52, 54 and cross strut 56 fixed with connectors 58. The kite sail fabric 36 defines frame member receiving pockets 62 at its periphery 64 outward of the sail fabric peripheral edge margin 34 which edge margin is thus inward of the pockets.

Sleeves 26 are attached only tangentially to the peripheral edge margin 34. That is, a single line of sewing or gluing attachment 65 lying on the sleeve perimeter 68 is used to secure the sleeve to the fabric 36. It has been found that this local attachment lets the sleeve 26 move readily about the locus L of attachment and prevents trapping of the sleeve and its contained conductors 24 during a flexing of the sail 14 or frame 46 that can lead to damage and loss of durability for the lighted kite 10. Flexing herein refers to movements of the frame 46 and/or the sail 14 that tend to crimp or strain the conductors 24 if the conductors were forced to follow these movements. Just allowing a single degree of freedom by only attaching the sleeves 26 at a single locus L reduces the chances that the sleeve and conductors 24 will be forced to follow the movements of the sail 14 and frame members 52, 54 on the periphery of the kite 10, or the center or cross-struts 48, 56 (where the conductors 24 are also desirably sleeved in a sleeve 26 that is only tied to the kite fabric 36 along a single locus).

In a preferred embodiment, the invention kite comprises a frame 46 of frame members 48, 52, 54 and 56 and a sail 14 comprising sail fabric 36 supported by the frame members. Sail fabric 36 has a laterally and longitudinally extended face 16, a peripheral edge 30 and a peripheral edge margin 34 inward of the peripheral edge. A plurality of light elements 18 are distributed on the face 16. An electrical power supply 22 is carried by the kite 10 for illuminating the light elements 18. Elongated electrical conductors 24 electrically communicate the power supply 22 and the light elements 18. The kite sail fabric peripheral edge 30 defines frame members 52, 54 receiving pockets 62. Kite sail fabric 36 further defines the elongated sleeves 26 for receiving the electrical conductors 24. As noted, the sleeves 26 have only a tangential attachment locus L for attachment to the sail fabric peripheral edge margin 34 and free movement relative to the sail and frame 36, 46 with the electrical conductors 24 therewithin about the tangential attachment locus when the kite 10 flexes, so that the electrical conductors are protected within the sleeves from damage from kite sail and frame flexing.

In more detail, the frame receiving pockets 62 comprise a flap 66 of the sail fabric peripheral edge 30 folded on itself and fastened to the sail fabric outboard of the edge 70 of the flap to leave a free flap continued extent 72. The electrical conductor receiving sleeves 26 are defined by the free flap continued extent 72, also folded on itself so that the fabric periphery is double folded, and fastened to the sail fabric 36. The flap 66 and the sleeve 26 are commonly fastened to the sail fabric 36 along a single fastening locus L with the pockets and sleeves being thereby defined on opposite sides S1, S2 of the locus.

In the invention method, electrical connectors 24 are protected in an illuminated kite having a frame 46, a sail 14, and a plurality of light elements 18 by folding an edge 30 of the sail on itself to form an electrical conductor receiving sleeve 26, and attaching the sleeve to the sail only on a tangential locus L to allow for free movement of the sleeve and the conductors therewithin about the tangential locus relative to the sail and frame upon flexing of the kite. Preferably, in accordance with the invention method, frame receiving pockets 62 are formed from a flap 66 of the sail fabric peripheral edge 30 folded on itself and fastened to the sail fabric 36 outboard of the edge 68 of the flap to leave a free flap continued extent 72. The electrical conductor receiving sleeves 26 are then formed from the free flap continued extent 72 folded on itself and fastened to the sail fabric 36 and with the sleeve 26 commonly fastened to the sail fabric 36 along a single fastening locus L.

The invention thus provides an illuminated kite in which the conductors are protected from damage from flexing of the kite frame or sail in flight or when packed away through the use of an effective and inexpensively adopted conductor protection system in a kite having conductor receiving sleeves peripherally disposed on the kite, suitably adjacent the frame pockets, and co-fastened there in a single, low-cost sewing operation. The containment of the conductors in a sleeve only tangentially connected to the kite sail enables the sleeve and the conductors therewithin to pivot about the tangential locus of fastening of the sleeve to the sail and to avoid being caught in a flexing movement of the sail or frame.

The foregoing objects are thus met.

We claim:

1. A kite comprising a frame and a sail, said sail having a laterally and longitudinally extended face; a plurality of light elements distributed on said face, an electrical power supply carried by said kite for illuminating said light elements, elongated electrical conductors electrically communicating said power supply and said light elements, said kite sail defining elongated sleeves for receiving said electrical conductors, said sleeves having only a tangential attachment locus for attachment to said sail and free movement relative to said sail and frame with said electrical conductors therewithin about said tangential attachment locus when said kite flexes, whereby said electrical conductors are protected within said sleeves from damage from kite sail and frame flexing.

2. The kite according to claim 1, in which said light elements comprise light emitting diodes.

3. The kite according to claim 1, in which said power supply comprises a battery.

4. The kite according to claim 3, in which said kite includes a receptacle pocket for carrying said battery.

5. The kite according to claim 1, in which said electrical conductors are wires comprising copper.

6. The kite according to claim 1, in which said kite has a peripheral edge margin, said light elements being distributed within said peripheral edge margin.

7. The kite according to claim 6, in which said light elements are supported on said kite peripheral edge margin in light element visible relation.

8. The kite according to claim 7, in which said sail comprises sail fabric, said light elements protrude through said sail fabric and are supported there by cooperating annular members on opposite sides of said sail fabric.

9. The kite according to claim 6, in which said elongated sleeves extend along said peripheral edge margins.

10. The kite according to claim 2, in which said power supply comprises a battery.

11. The kite according to claim 10, in which said kite includes a receptacle pocket for carrying said battery.

12. The kite according to claim 11, in which said electrical conductors are wires comprising copper.

13. The kite according to claim 12, in which said kite has a peripheral edge margin, said light elements being distributed within said peripheral edge margin.

14. The kite according to claim 13, in which said light elements are supported on said kite peripheral edge margin in light element visible relation.

15. The kite according to claim 14, in which said sail comprises sail fabric, said light elements protrude through said sail fabric and are supported there by cooperating annular members on opposite sides of said sail fabric.

16. The kite according to claim 15, in which said elongated sleeves extend along said peripheral edge margins.

17. The kite according to claim 16, in which said kite frame comprises frame members, said kite sail comprises sail fabric, said sail fabric has frame member receiving pockets at its periphery, said sail fabric has a peripheral edge margin inward of said pockets, said sleeves being attached tangentially to said peripheral edge margin, said electrical conductors lying within said sleeves in kite flexing protected relation, said light elements being connected to said electrical conductors and protruding from said sleeves in light displaying relation.

18. A kite comprising a frame of frame members and a sail comprising sail fabric supported by said frame members, said sail fabric having a laterally and longitudinally extended face, a peripheral edge and a peripheral edge margin inward of said peripheral edge; a plurality of light elements distributed on said face, an electrical power supply carried by said kite for illuminating said light elements, elongated electrical conductors electrically communicating said power supply and said light elements, said kite sail fabric peripheral edge defining frame member receiving pockets, said kite sail fabric further defining elongated sleeves for receiving said electrical conductors, said sleeves having only a tangential attachment locus for attachment to said sail fabric peripheral edge margin and free movement relative to said sail and frame with said electrical conductors therewithin about said tangential attachment locus when said kite flexes, whereby said electrical conductors are protected within said sleeves from damage from kite sail and frame flexing.

19. The kite according to claim 18, in which said frame receiving pockets comprise a flap of said sail fabric peripheral edge folded on itself and fastened to said sail fabric outboard of the edge of said flap to leave a free flap continued extent, said electrical conductor receiving sleeves being defined by said free flap continued extent fastened to said sail fabric.

20. The kite according to claim 19, in which said free flap continued extent is also folded onto itself and said flap and said sleeve are commonly fastened to said sail fabric along a single fastening locus with said pockets and sleeves being thereby defined on opposite sides of said locus.

21. A method of protecting electrical connectors in an illuminated kite having a frame, a sail, and a plurality of light elements, including folding an edge of said sail on itself to form an electrical conductor receiving sleeve, and attaching said sleeve to said sail only on a tangential locus to allow for free movement of said sleeve and the conductors therewith about said tangential locus relative to said sail and frame upon flexing of said kite.

* * * * *